US008918969B2

(12) United States Patent
Jenson

(10) Patent No.: US 8,918,969 B2
(45) Date of Patent: Dec. 30, 2014

(54) FUNERAL CONTAINER CARRYING DEVICE

(71) Applicant: Charles T Jenson, Carmel, IN (US)

(72) Inventor: Charles T Jenson, Carmel, IN (US)

( * ) Notice: Subject to any disclaimer, the term of this patent is extended or adjusted under 35 U.S.C. 154(b) by 0 days.

(21) Appl. No.: 14/065,571

(22) Filed: Oct. 29, 2013

(65) Prior Publication Data

US 2014/0115843 A1 May 1, 2014

Related U.S. Application Data

(60) Provisional application No. 61/719,846, filed on Oct. 29, 2012.

(51) Int. Cl.
*A61G 17/00* (2006.01)
*A61G 17/02* (2006.01)

(52) U.S. Cl.
CPC ..... *A61G 17/02* (2013.01)
USPC ..... 27/27; 16/424; 294/27.1

(58) Field of Classification Search
CPC . A61G 17/04; A61G 2017/041; A47B 95/02; B65D 5/46008; B65G 7/12; B25G 1/06
USPC ..... 27/2, 4, 27; 16/422, 424, 425, 436, 439; 220/759; 229/117.11, 117.19; 294/15, 294/32, 27.1, 68.1
See application file for complete search history.

(56) References Cited

U.S. PATENT DOCUMENTS

| | | | | | |
|---|---|---|---|---|---|
| 275,665 | A | * | 4/1883 | Johnson | 27/27 |
| 532,073 | A | * | 1/1895 | Klar | 16/424 |
| 576,358 | A | * | 2/1897 | Antes | 16/424 |
| 687,889 | A | * | 12/1901 | Kulp | 16/424 |
| 737,580 | A | * | 9/1903 | Carpenter | 27/27 |
| 878,985 | A | * | 2/1908 | Montross | 27/27 |
| 937,086 | A | * | 10/1909 | Montross | 27/27 |
| 1,260,927 | A | * | 3/1918 | McKinney | 27/7 |
| 1,660,019 | A | * | 2/1928 | Tazza | 27/2 |
| 2,759,239 | A | * | 8/1956 | Snyder | 27/27 |
| 2,802,253 | A | * | 8/1957 | Birck | 27/27 |
| 3,192,596 | A | * | 7/1965 | Gruber | 27/12 |
| D218,890 | S | * | 10/1970 | Kreminksi | D99/8 |
| 4,315,354 | A | * | 2/1982 | Behrendt | 27/27 |
| 4,823,448 | A | * | 4/1989 | Martin | 27/35 |
| 4,930,197 | A | * | 6/1990 | McClive | 27/2 |
| D329,317 | S | * | 9/1992 | Bell, Jr. | D99/8 |
| 5,482,339 | A | * | 1/1996 | Chishko, Jr. | 294/27.1 |
| 5,522,116 | A | * | 6/1996 | Enneking et al. | 16/424 |
| 5,531,000 | A | * | 7/1996 | Biondo | 27/27 |
| 5,586,376 | A | * | 12/1996 | Enneking et al. | 27/27 |
| 7,213,312 | B2 | * | 5/2007 | Foroni | 27/4 |
| 7,249,403 | B2 | * | 7/2007 | Davis et al. | 27/27 |

* cited by examiner

*Primary Examiner* — William Miller
(74) *Attorney, Agent, or Firm* — E. Victor Indiano; Indiano Law Group LLC

(57) ABSTRACT

A carrier is provided for facilitating the carrying and transportation of a funerary container having a bottom surface, a plurality of side surfaces and a top surface, along with a length and width and interior large enough to accommodate an uncremated corpse. The carrier includes a base member having a length generally long enough to span the width of the funerary container and a upper surface sized and configured for receiving the bottom surface of the funerary container. An upstanding member has a lower end coupled to the base member and an upper end. The upstanding member extends in a plane generally perpendicular to the base member. A handle member is provided that is coupled to the upstanding member. The handle includes a hand receiving surface engageable by the hand of the user.

15 Claims, 10 Drawing Sheets

FUNERAL CONTAINER CARRYING DEVICE

PRIORITY STATEMENT

The present application claims benefit of priority to Jenson, U.S. provisional patent application No. 61/719,846, that was filed on 29 Oct. 2012 and which is fully incorporated herein by reference.

TECHNICAL FIELD OF THE INVENTION

The present invention relates to funeral products and more particularly, to a carrier for aiding in the transport of a funeral container.

BACKGROUND OF THE INVENTION

After death, it is traditional to place the corpse into a container. Containers into which bodies are placed take several different forms, and serve several different functions. A flexible, plastic, zipper-containing bag container known as a body bag, is often employed to transport a dead body from the place at which a person died, to a body holding or preparation area, such as a morgue or funeral home. Once at the funeral home or morgue, a body is often placed on a gurney for purposes of performing an autopsy, embalming the body and/or otherwise preparing the body for a viewing, interment or cremation. After the autopsy or embalming or other procedure is complete, the body is then usually placed in another container. In a large number of cases, the other container into which the body is placed is a "permanent" casket or coffin, that is suitable not only for holding the body but also for placement into the ground; or into a crypt or niche if the body is buried above ground.

Caskets and coffins have been used since at least the time of the ancient Egyptians. To be precise, a coffin and a casket, while both comprising funerary boxes, refer to different items in current understanding. A coffin usually refers to a six-sided funerary box whereas a casket refers to a four-sided funerary box. In this application, the terms casket and coffin will be used interchangeably to refer broadly to a funerary container intended to contain a deceased body.

Current caskets and coffins are made from a variety of different materials, such as wood, metal, and fiberboard. Typically, such permanent caskets have sufficient structural integrity and rigidity to maintain their intended shape, and not bend or collapse when the weight of a body is placed in the casket, when the casket is being transported.

Handles are usually provided on the side(s) and/or ends of a casket to facilitate the carrying of the casket by pall bearers. These handles are usually secured on the side of the casket by fasteners such as bolts, and the like. Since most permanent caskets are made from a relatively heavy gauge steel or wood material, most caskets have sufficient structural integrity so that the pall bearers can grab the handles, and lift the casket off the bier, and transport the casket by carrying it by its handles. Because of this structural rigidity, the casket will maintain its generally rectangular, cuboid, box-like shape during such a process, and will not collapse or bend or sag in a manner in which one might expect a less sturdy container to bend or fold when a heavy weight is placed therein, especially when a heavy, non-structurally rigid weight, such as a body is placed therein.

In addition to the permanent type caskets described above, there is growing use of non-permanent or "temporary" caskets, that are referred to as "cremation caskets" in tribute to their intended purpose. Cremation involves the placement of a body in an industrial furnace called a cremator, that includes a chamber, called a retort, in which the body is placed for burning. In the retort, the body is burned until the body is reduced to a "powder-like" ash material known as "cremains" that comprises mineral fragments. Since the body is reduced to a few pounds of cremains, there is no need for a permanent casket having sufficient structure and strength to maintain its integrity when buried in the ground for many centuries.

Actually, the use of a permanent type casket in a cremation setting is counter productive for at least two reasons. The first reason relates to costs. Because of their structural, integrity and decorative aspects, permanent caskets are usually quite expensive. At the time of this writing, the "retail" price of permanent caskets typically vary from between about $700.00 to $15,000.00. It is quite a waste of material and money to employ a $15,000.00 casket for only a four hour viewing, and an hour long church service and then to discard the casket within a retort, wherein the casket will be effectively destroyed and burned.

A second drawback with the use of a permanent casket in a cremation process relates to the increased difficult of burning a permanent casket when compared to the time and energy required to burn just a body. Even though a wood casket will burn quite well, the time required to burn a body in a wood casket to its appropriate "cremains" state often requires significantly more time, and hence, entails significantly greater fuel costs than a cremation where only a body is burned. A metal casket will likely require an even longer time than a wood casket to be burned completely, and require the expenditure of even a greater amount of fuel, such as natural gas.

Because of these drawbacks encountered with the use of "permanent caskets", many bodies that are destined for cremation are contained within a "cremation casket".

Currently, there are several types of cremation caskets that exist, and are being used. One factor that governs the particular type of casket used is the cost that the relatives of the deceased are willing or capable of paying for the service and cremation. A second factor that affects the type of cremation casket employed is whether the cremation casket is going to require decorative aspects. A third factor relates to body weight of the deceased as some cremation caskets must be reinforced in order to properly hold and contain bodies of a certain weight or size.

A fourth factor that may affect the choice of a cremation casket relates to transportation. Often, a person will die at a place far removed from the place at which the body is ultimately to be buried. Planes and trucks are employed to transport the body back "home" for burial. To ensure that the integrity of the container is maintained during flights and that the body does not fall out of its container, transportation authorities and carriers often set minimum standards of structural rigidity and integrity that must be met before the transportation carrier will accept the body for transport.

Probably the most simple and least expensive cremation casket comprises a casket-size corrugated box. The cremation casket box will typically be constructed similarly to a corrugated box that is employed to hold a case of copier paper. That is, the box will be a two-piece box, having a base portion that is generally rectangularly cuboid, an open top and may have a depth of, for example, 12 inches or so. A separable tray-shaped lid having an upper surface and downwardly extending side flanges will have a length and width slightly larger than the base portion of the box, so that the lid can fit over the box such that the downwardly extending flanges of the lid engage the upper portions of the outer side surfaces of the lower base of the box.

A variation of this cardboard box is what might be termed a "viewing cremation casket". At its simplest, a viewing cremation casket is similar to the simple corrugated box disclosed above. However, the viewing cremation casket may include fabric members and pillows that are fixedly placed within the interior of the box, so that the interior of the cremation casket maintains an appearance similar to that one might expect from a traditional, permanent casket. Additionally, the viewing cremation box/casket may include a "riser level" that comprises a secondary bottom member. The height and angle of the secondary bottom can be adjusted relative to the primary bottom, in much the same way that the riser shelf of a permanent casket is adjustable relating to the bottom member of a traditional casket.

By changing the height and position of the riser shelf, the body can be angled upwardly in a rested position, so that a body resting within the "viewing cremation box" will have an appearance similar to that one might have if the body were placed in a traditional permanent casket.

The "viewing cremation casket" may be used alone, by placing some sort of decorative material or indicia on the exterior surface of the viewing box. Alternately, the viewing cremation casket may be placed within a "rental casket" also known as a re-useable casket. A rental casket is a hybrid-type casket, that generally includes an outer shell. The outer shell has the structural strength and integrity of a permanent casket, along with the decorative attributes of a permanent casket so that the rental casket has an external appearance of a permanent casket. However, the rental casket also has an undecorated interior that is designed to receive a removable liner, such as the viewing casket box.

Rental caskets are often employed when the family wishes to have a viewing or church service for a deceased member whose body is bound for cremation, before the actual cremation occurs. Rather than spending the several thousands of dollars for a full permanent casket, one can often use the rental casket, by placing a viewing box type cremation casket within the interior of the rental casket. Prior to cremation, the viewing cremation casket is removed from the rental casket, and transported to the crematorium, wherein the viewing type rental casket is inserted into the retort, and burned along with the body. The re-useable casket shell then be fitted with another viewing cremation casket and used for another person.

Cremation caskets can also be constructed similarly to either the viewing casket or the "plain box" cremation casket described above, but additionally include reinforcement. Often, a cheap wood, pressed board or plywood member, having dimensions that are sized to permit it to be placed on the bottom interior surface of the cremation box are employed for reinforcement. These reinforcing boards help to reinforce the bottom of the cremation casket, to give it additional strength and rigidity to make it better able to hold the weight of a body, without bending, folding or collapsing. Such reinforcing boards are especially useful and can be necessary in oversized or barriatric caskets that are employed for especially large and or heavy individuals.

Since the reinforcing board is usually disposed interiorly of the casket, and below the drapery and cloth of a viewing casket, it is usually not seen by anyone other than the funeral director. As the wood has no decorative purpose, a cheap wood or wood byproduct, such as Masonite or pressed board can be employed, as there is no need to incur the expense of employing a finer wood, such as a pine, oak, maple or the like.

A fourth type of cremation casket comprises a wooden cremation casket. A wooden cremation casket, is heavier and more durable than a cardboard container, and as such, is more expensive. However, in situations where durability is necessary, such as for bodies that are being transported by airplane or truck to a distant location, the added cost is well justified, as the additional durability is necessary. These "wood box" containers are different than permanent caskets, as they usually have no decorative features and may not have the air and moisture imperviousness of permanent caskets. Because they lack decorative attributes, these containers can be made reasonably inexpensively and cost-effectively, by using a cheaper burnable material, such as pressed board, Masonite or plywood, rather than a more expensive furniture-grade wood, such as is used in typical permanent caskets. The use of metal should be avoided, because of the greater difficulty encountered in burning metal vis-a-vis a more burnable material such as wood.

One of the difficulties encountered with such cremation caskets involves their transportation. The two primary methods for moving caskets from one place to another involve either carrying the casket in a manner similar to the manner in which pall bearers carry a traditional casket, or else moving the casket along a surface (such as a floor) by placing the casket on top of what is known as a "church cart".

Although the wood board-type caskets, such as the airplane cremation casket discussed above probably have sufficient structural integrity and rigidity to be transported easily by carrying or church cart, the cardboard cremation caskets often lack sufficient structural integrity to withstand the stresses imposed by carrying or church carts without breakage.

Permanent caskets typically contain handles that are affixed to the side of the casket. These handles can be grabbed by a pall bearer so that the casket can be picked up and moved. This is not the case with cardboard caskets generally. Handles that are placed on the side of a cardboard casket may not be sufficiently durable serve as handles without malfunctioning to make them advisable to use.

One difficulty with the placement of a handle on the side of a cardboard box is that the cardboard material from which the box is made may not have enough structural integrity to withstand the forces that are imposed on the cardboard through the gripping of a handle and the lifting of a cremation casket, especially when that casket is filled with a heavy body. A handle coupled to the side of the cardboard casket has the potential to become dislodged from the casket due to the cardboard tearing, or else the handle become dislodged from the side of the casket, thus causing a potentially embarrassing accident with the deceased. Additionally, such caskets are often not well suited for use with church carts.

An example of a church cart is shown in FIG. 3. The church cart typically includes a scissor-like mechanism, wherein the scissor mechanism is hinged between a first end frame and a second end frame. The first and second end frames each include an upper frame and a lower frame. The lower frame includes wheels to enable the cart to roll along a surface. The upper frame usually includes four post members. In a typical funeral, the permanent casket is placed upon the four post members and is supported by the four post members. This support of the casket on the church cart enables the casket to be rolled along a surface, such as an aisle of a church.

Unfortunately, the top post members of a church cart present a small surface area to the underside of the casket, as the posts of a church cart may each have a diameter of less than one inch. Simple notions of pressure, and stresses imposed on a pounds per square inch basis suggest that a placement of a relatively heavy load within a relatively thin cardboard box upon four posts can result in a situation wherein the four upstanding posts of the church cart can pierce through the bottom of the cardboard cremation casket.

As such, using church carts to transport cardboard box-like cremation caskets can be problematic because of the potential to pierce the underside of a cardboard box type cremation casket.

Therefore, it is one object of the present invention to provide a device that aides in the transport and carrying of a casket or casket-like container that can be used either with a traditional casket or casket-like container, but can also be used with casket or casket-like containers having a lower level of structural integrity, such as is found in a container made from cardboard.

In addition to the difficulties in moving cremation caskets, other difficulties arise that impact both cremation caskets and also, more traditional permanent caskets. One such difficulty arises in the placement of a casket (usually a traditional casket), within a mausoleum. Typically, mausoleums are constructed so that the width of an opening to a mausoleum crypt is only slightly wider than the width of a typical casket.

In most mausoleums, the crypts are disposed in a wall-like arrangement. The crypts are disposed side by side throughout the length of the wall. Additionally, the crypts are stacked in columns, wherein the first crypt is usually disposed at or slightly above floor level, and the upper most crypt is disposed adjacent to the ceiling. A typical mausoleum building may have several walls of this type, to hold hundreds or possibly thousands of crypts.

It is often difficult to efficiently insert a casket within a particular crypt, in a dignified manner. The insertion difficulty arises because of the relatively tight tolerances between the width of the casket and the width of the crypt. Often, the width of a crypt is insufficient to enable the handles of the side of the casket to be employed, since the handles on the side of the casket often pivot outwardly to facilitate gripping. When the handles are pivoted outwardly, the width of the casket, including the extended handles, is often wider than the width of the crypt.

Compounding the difficulty is the fact that many handles that are coupled to the side of the caskets are long, bar-like handles, such that the side of a casket may include a single "full length" handle that is supported by three hinges, and which is approximately five feet in length. As the handle is unitary, the handle pivots outwardly as a unit. Therefore, the entire handle must be placed in its rest position (not pivoted outwardly) in oder to move the head end of the casket into the crypt. This thereby renders the entire, full length handle useless for further supporting the carrying of the casket.

As such, it is therefore an object of another aspect of the present invention to provide a transporter for a casket, or a casket-like container that enables a casket to be maneuvered, and transported easily, so that the casket can have the ability to be more easily insertable into narrow crypts or crypt-like spaces.

SUMMARY OF THE INVENTION

In accordance with the present invention, a carrier is provided for facilitating the carrying and transportation of a funerary container having a bottom surface, a plurality of side surfaces and a top surface, along with a length and width and interior large enough to accommodate an un-cremated corpse. The carrier comprises a base member having a length generally long enough to span the width of the funerary container and a upper surface sized and configured for receiving the bottom surface of the funerary container. An upstanding member has a lower end coupled to the base member and an upper end. The upstanding member extends in a plane generally perpendicular to the base member. A handle member is provided that is coupled to the upstanding member. The handle includes a hand receiving surface engageable by the hand of the user.

Preferably, the upstanding member includes a central section, and at least one side section, wherein the handle is coupled to the side section. The side section is disposed in a plane that is generally perpendicular to the plane in which the central section is disposed, with both of the side sections and central section being disposed in planes that are generally perpendicular to a plane in which the base member is disposed. Additionally, the upstanding member can include a second side section that is disposed in plane generally parallel to the plane in which the first section is disposed. The first and second side sections include handle engaging portions, such that the handle engages the handle engaging portion of the first and second side sections.

In a most preferred embodiment, the handle portions of each of the first and second side sections includes a longitudinal slot in communication with a plurality of spaced adjustment slots. The longitudinal slots of the handle engaging portion of the first and second side sections extend between the plurality of adjustment slots, and the adjustment slots are disposed at an oblique angle to the longitudinal slots. The handle can move in the longitudinal slots between adjustment slots, and can reside in the adjustment slots, to fixedly position the handle with respect to the carrier when the carrier is being used to transport a funerary container.

In a preferred embodiment, the base member is generally planar in configuration, and has a width of somewhere between about four and ten inches. Also, the carrier members are used in pairs when transporting a casket, to provide a stable, secure and easily maneuverable vehicle for transporting a casket, and especially an alternative or temporary casket.

One feature of the present invention is that a base member is provided that can be placed under a casket, to support the bottom surface and a handle portion is provided that can extend along one or two sides of the casket for enabling a user to grip the handle. This feature has the advantage of both supporting the underside surface of the casket, and also, providing a convenient way to move a casket, and especially a non-permanent cremation casket.

As discussed in the background of the invention portion of the present invention, a temporary or cremation casket is often made out of a cardboard material, such that the cremation casket comprises a cardboard box having a casket-shape and casket dimensions. In order to minimize the amount of material that needs to be burned during cremation, and to minimize the costs of manufacturing such a casket, a cardboard material is employed as it both burns quite well with only a minimum of ash type residue, and can be produced rather inexpensively.

Unfortunately, one draw back with such a cardboard container is that it may not have sufficient structural rigidity to enable the manufacturer to place handles on the side of the box that are strong enough to withstand the stress inherent in moving a body containing casket. Because of the weight of the body contained within the casket, the use of a handle attached to a cardboard box may tear the cardboard with the handle's anchor being pulled through the cardboard. This can result in a body contained within the box falling out of the box while being transported. Such a malfunction would embarrass the funeral director and upset the friends and relatives of the deceased.

Another feature of the present invention is that the carrier members are not permanently affixed to the casket, and thus, are variably positionable, and movable along the length of the casket. This ability of the carriers to be moved along the base of the casket enables the user to place the carrier under the casket at a position where the casket can best be supported, and collapse or box failure can best be prevented. Additionally, the ability of the carrier to be moved along the length of the casket can be helpful when the casket is loaded into a funeral car or into a retort, since a casket is usually loaded into a retort or hearse in a manner wherein the inserted end of the casket becomes progressively inaccessible as the casket is increasingly inserted into the hearse or retort.

These and other features and advantages of the present invention will become apparent to those skilled in the art upon a detailed review of the drawings and detailed description that represent the best mode of practicing the invention perceived presently by the Applicant.

DETAILED DESCRIPTION OF THE PREFERRED EMBODIMENT

Before delving into the details of the device of the present invention, it is important to understand and appreciate the funerary containers with which the present invention will be used. These are shown in FIGS. 1-3.

Figure 1:
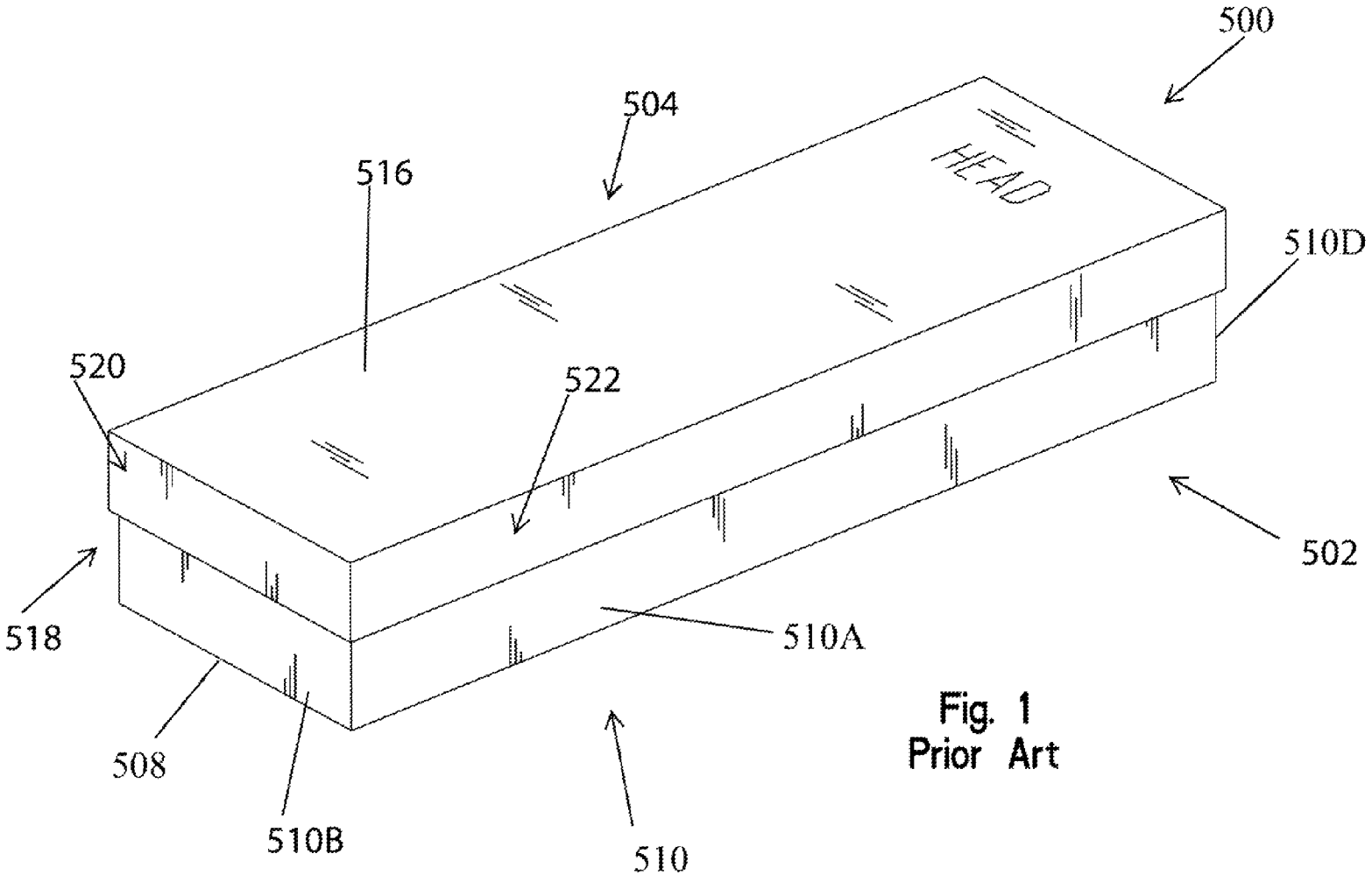
Fig. 1 Prior Art
FIG. 1 comprises a perspective view of a funerary container, here shown as a cremation casket for which the present invention is especially useful for transporting.
Figure 2:
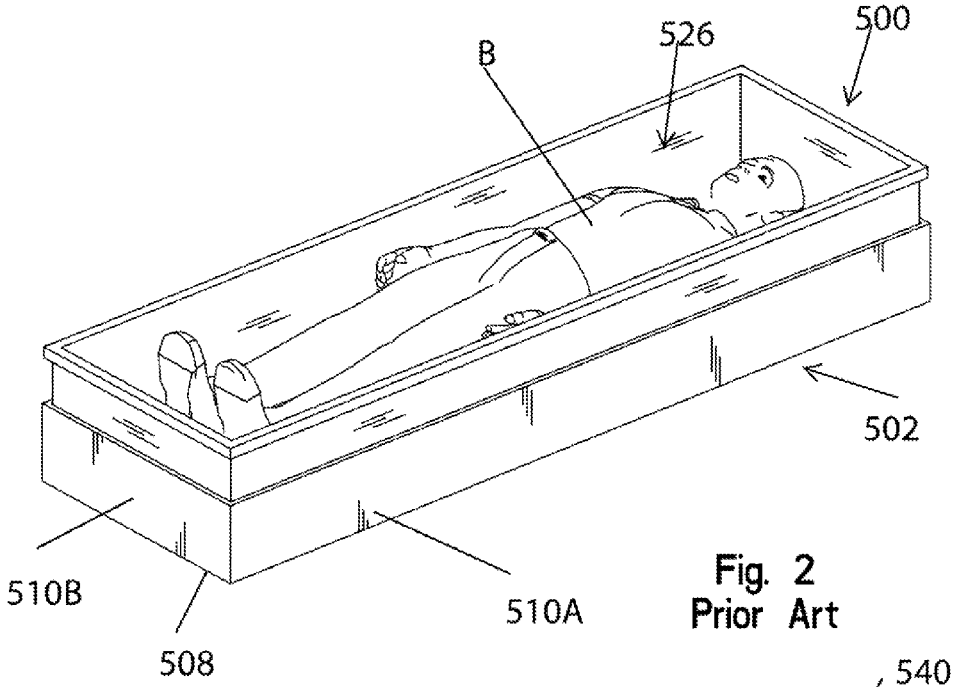
Fig. 2 Prior Art
FIG. 2 is a perspective view of a cremation casket showing the lid of the casket removed from the base portion of the casket and a body placed therein.
Figure 3:
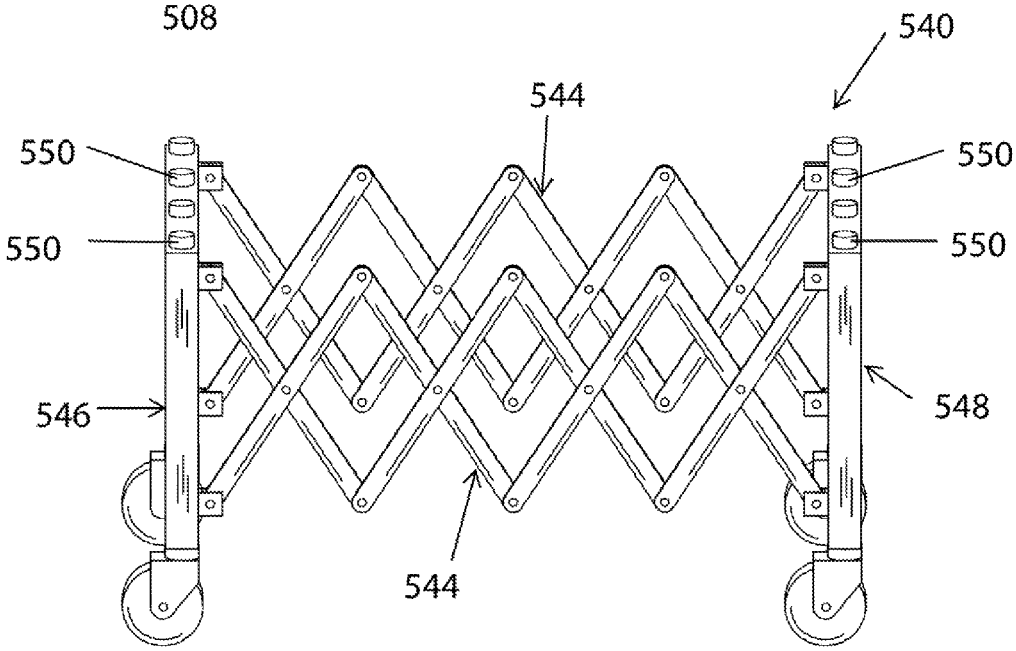
Fig. 3 Prior Art
FIG. 3 is a perspective view of a church cart, of the type used to transport a casket along a surface, such as a church aisle or funeral home floor.
Figure 4:
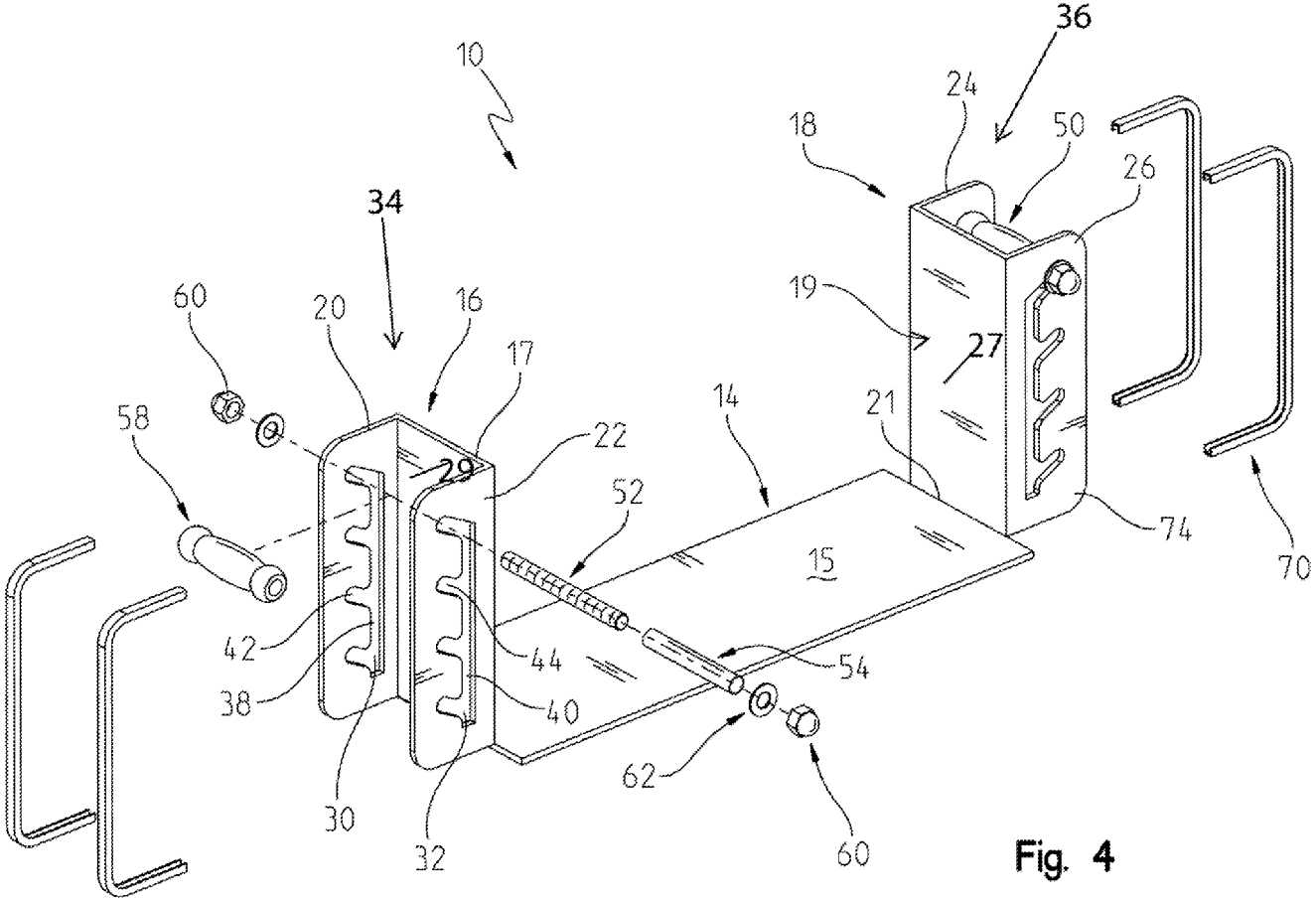
FIG. 4 is an exploded perspective view of a carrier of the present invention.

As shown in the figures, and particularly FIGS. 1-3, a funerary container that comprises a cremation casket 500 is shown as comprising an elongated rectangularly cuboid, cardboard box. The cardboard box includes a base member 502 and a lid member 504. The base portion 502 includes a generally planar bottom surface 508, and four upright side portions 510, including a first long side portion 510A, a second long side portion 510C, a first end side portion 510B and a second end side portion 510D. The long side portions 510A, 510C are generally longer than the end side portions 510B, 510D, with the long side portions 510A, 510C being approximately six feet long, and the end side portions 510B, 510D being approximately 27 inches wide.

The lid member 504 is configured generally similarly to the base member 502 as it includes a planar, horizontally disposed top member 516 and four side flaps including a pair of long side flaps 520 and a pair of end side flaps 522. The side flap members 518 are disposed in planes that are generally perpendicular to the top member 516, except that it is not as deep, and has a slightly longer length and width, so that the lid member 504 can fit over the base member 502 in much the same way that a lid used on a case of copier paper fits over the base of the case of typing paper.

Typically, the base member 502 will have a depth of about 9 to 12 inches and the lid 504 may have a depth of three to four inches.

Turning now to FIG. 2, the interior 526 of the cremation casket 500 is shown. The container is shown having a body B placed therein. The interior of the cremation casket 500 is generally large enough to accommodate a typical body B. Because of the wide variation in body sizes, cremation caskets 500 are made in a variety of sizes. Although the typical container 500 is usually slightly longer than six feet in length, and approximately 27-28 inches in width, "barriatric caskets" are made that are substantially wider than 27 inches to accommodate larger, longer bodies with some caskets having widths of 52 inches. Additionally, caskets 500 can be longer than six feet to accommodate taller people.

As discussed in the Background of the Invention, the container 500 can be little more than a corrugated cardboard box. Such cardboard box-type caskets may include a reinforcing member, such as a board-shaped slab of press board (e.g. 68"×18"×0.5") coupled to the bottom surface to prevent the bottom of the box from cnunmpling, tearing, sagging or bending. Further, the cremation container 500 can be made into a viewing container that includes a mattress, a pillow, and decorative cloth materials therein, so that the interior 526 of the container 500 has an appearance similar to the upholstered appearance that one might expect from a traditional casket.

One difficulty with such alternative caskets 500 is that they are difficult to transport. The forces placed on the bottom member 508 of a body containing cremation casket 500 have the potential to bend the bottom member 508. Additionally, it is difficult to affix a secure handle to a cardboard box type cremation casket because the tearing stress that the handle places on the cardboard may be sufficiently great enough to cause the handle to tearingly pull through the cardboard when the handle is being used to move a cremation casket containing a weighted body is being moved.

Turning now to FIG. 3, a casket transport cart, referred to commonly as a church cart 540 is shown. Church carts 540 are employed by funeral directors to move a body container, such as a casket across a surface such as a floor. Church carts 540 are typically made with a scissor-hinge 544 that extends between a pair of upright frame 546, 548 members. The scissor hinge 544 enables the church cart to be scissored together to partially collapse to take up less space when the church cart is being transported, such as when the church cart 540 is being transported between the funeral home, church, crematory and/or cemetery.

Church carts 540 were originally designed to be used in connection with traditional caskets rather than alternative cremation-friendly caskets. One difference between a traditional casket and an alternative casket is that a traditional casket has a bottom member that is usually made from a puncture resistant thick wood or a metal, such as an 18, 14, 12 or even 10 gauge metal. Because of the strength of the metal or the wood, there is little likelihood that the bottom surface can be punctured, by one of the posts 550 of the church carts 540.

One or more post members 550 is disposed at the top of each of the frame members 546, 548. Typically, a post member 550 extends upwardly at each of the four corners of the church cart 540. In the church cart shown in FIG. 3, there are a series of upstanding post members 550 that extend across the top frame. Often the post members 550 have a diameter of about one inch or less and may also include an upstanding knob member to exert additional pressure upon the underside surface of the casket to better help maintain the casket in its lateral position on the church cart 540, and thereby help prevent the casket from sliding off the church cart 540.

Although such a post arrangement 550 works well with traditional caskets because of their puncture resistant bottom members, such church carts often cause problems with cremation containers. In particular, the small diameter post members 550 are capable of exerting sufficient pressure upon the bottom member, when said bottom member is made from a cardboard material to actually puncture through the bottom member of the alternative casket 500.

A first embodiment of the casket carrier 10 of the present invention is shown in FIGS. 4-10. The casket carrier 10 is shown in an exploded view in FIG. 4, as including a base member 14 that is generally sheet-like and planar in configuration, and has a length of about 28 inches and a width of about 8 inches. The planar base member 14 is preferably made from stainless steel and includes an upper surface 15, and a lower surface 13.

First and second sheet-like upstanding members 16, 18 are disposed at either side edge of the base member 14. The upstanding members each include an interiorly facing surface 27 and an exteriorly facing surface 29. The upstanding members 16, 18 have lower end portions that are joined to the side edges of the base member 14. Preferably, the base member 14 and upstanding member 16, 18 are formed from a unitary piece of steel, that starts out as a flat piece of stainless steel. The steel is then cut appropriately, along the edges of the base member 14 and the upstanding members 16, 18. Initially, the upstanding members 16, 18 are disposed generally co-planarly with the base member 15. The first and second upstanding members are then bent around the respective bend lines, such as bend line 21, to form the casket carrier into the shape shown in FIG. 4 wherein the base member 14 is disposed in a plane that is generally perpendicular to the planes in which the upstanding member 16, 18 are disposed, and wherein the upstanding members are disposed in spaced parallel planes.

Figure 8:
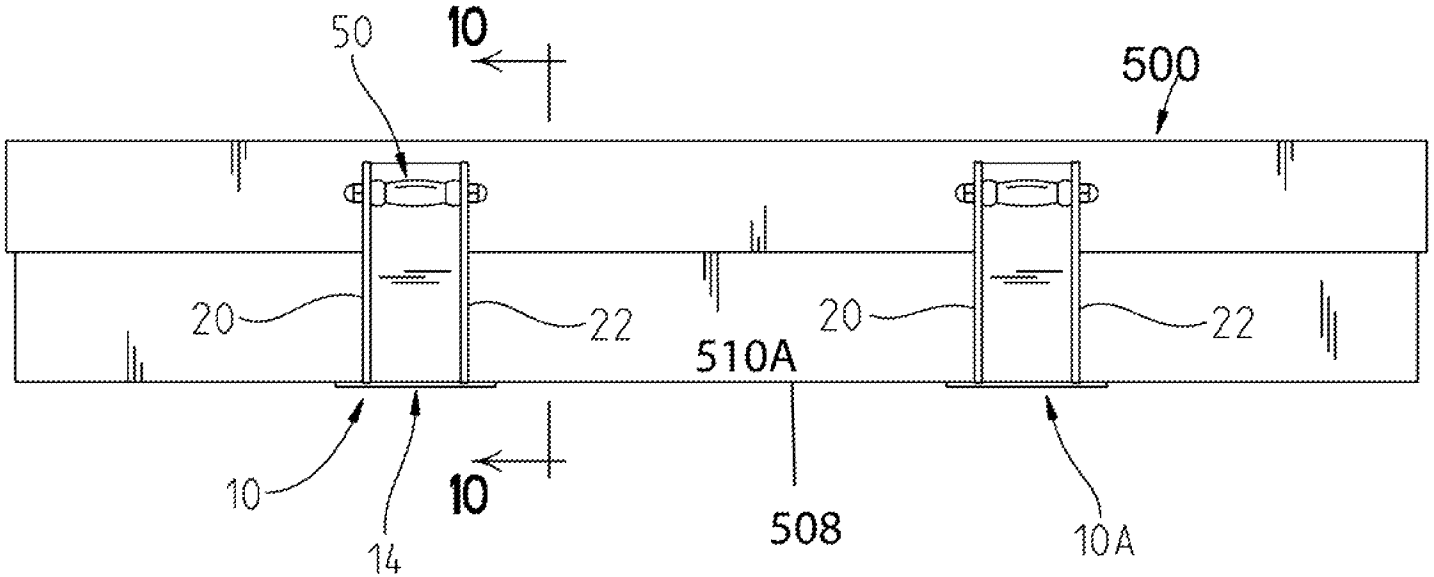
FIG. 8 is a side view of a cremation casket wherein the carriers are engaged with the cremation casket to permit the cremation casket to be carried by pall bearers.

The upstanding members each include an upstanding, central support portions 17, 19. Upstanding support portions 17, 19 are generally planar and uncut. The upstanding central support portions 17, 19 extend in a plane generally perpendicular to the major plane of the base member 14. Additionally, the central support portions 17, 19 extend in a plane that is generally parallel to the planes in which the side surfaces (e.g. 510A, 510C) of the casket 500 or alternative container extend. When in use, the upstanding central support portions 17, 19 are disposed adjacent to the side portions 510A, 510C of the casket 500, as is best shown in FIG. 8.

Additionally, each of the first and second side portions 16, 18 include first and second flange-like adjustment assemblies 34, 36. The first upstanding member 16 includes first and second flange-like side section adjustment plates 20, 22, and the second upstanding member 18 includes first and second flange-like side section adjustment plates 24, 26. The first and second flange like adjustment plates 20, 22 and 24, 26 are disposed in planes that are generally perpendicular to each of the planes in which the upstanding central support portions 17, 19 and base member 14 reside, respectively. The first and second adjustment plates 20, 22 of the first upstanding member 16 are sheet-like, and are disposed in a parallel plane with respect to each other. The first and second adjustment plates 24, 26 of second upstanding member 18 are also sheet-like and disposed in parallel plane. Most preferably, the first adjustment plates 20, 24 are disposed co-planarly with each other; and the second adjustment plates 24, 26 of the respective first and second upstanding member 16, 18 are disposed co-planarly. The adjustment plates 24, 26 of the second upstanding member 18 also include longitudinal slots 31 (not shown) respectively, that each include four angled adjustment slot resident portion 35.

The first and second adjustment members 20, 22 of the first upstanding member 16 each include an adjustment slot formed therein. The adjustment slots 30, 32 respectively, are disposed in parallel planes and are aligned with each other. Each of the adjustment slots includes a longitudinally extending adjustment portion 38, 40 and an angled resident portion such as angled resident portions 42, 44 that are disposed at an oblique angle to the longitudinal slot. On the embodiment shown in FIG. 4, it will be noted that four residents portions (adjustment slots) exist in the adjustment slot array 30, 32.

A handle 50 is provided that is movable within the adjustment slots and can be resident in any of the four resident slots. The handle member includes a central rod 52 that has first and second threaded ends for receiving respectively, first and second acorn bolts 60, 62 and washers to maintain the rod 52 in its position between the first and second adjustment members 20, 22. A plastic tube member 54 has a central passageway for interiorly receiving the threaded rod 52. A cushioned gripping handle 58 has an interior passageway for receiving the plastic sleeve member 54 and the threaded rod 52, so that both of the plastic sleeve member 54 and the threaded rod 52 are disposed within the interior passageway of the handle 58. Preferably the threaded rod, plastic tube and handle 58 are sized to permit the handle 50 to be rotatable with respect to the carrier and the adjustment resident slots 35.

The handle 58 is preferably made from a solid material, such as wood, metal or plastic to which a soft cushioning material such as a rubber or foam, and may have a shape that is designed either to be decorative or ergonomically friendly to a hand that is gripping the handle portion 58. The plastic sleeve member 54 helps to ensure that the handle 58 is rotatable with respect to the threaded rod 52, as such rotatablility helps to enable the user to get a more secure and comfortable grip on the handle 58 when moving a casket.

A rubber edge cover 70 is provided for being placeable over the edge 74 of the side sections 20, 22, 24, 26 of the upstanding member 16, 18. This helps to prevent the user from getting cut or scraped on the edge 74. The guard member 70 is preferably made from a formed rubber or plastic and includes a channel for interiorly receiving the edge of the side sections 20, 22, 24, 26 of the upstanding members 6, 18. Two guards are used for each upstanding member 16, 18, one for each of the edges of the side section adjustment members 20, 22.

Figure 6:
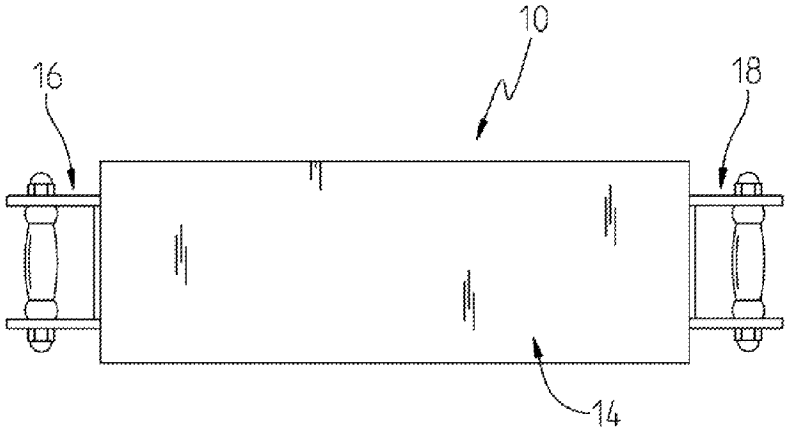
FIG. 6 is a bottom view thereof.
Figure 5:
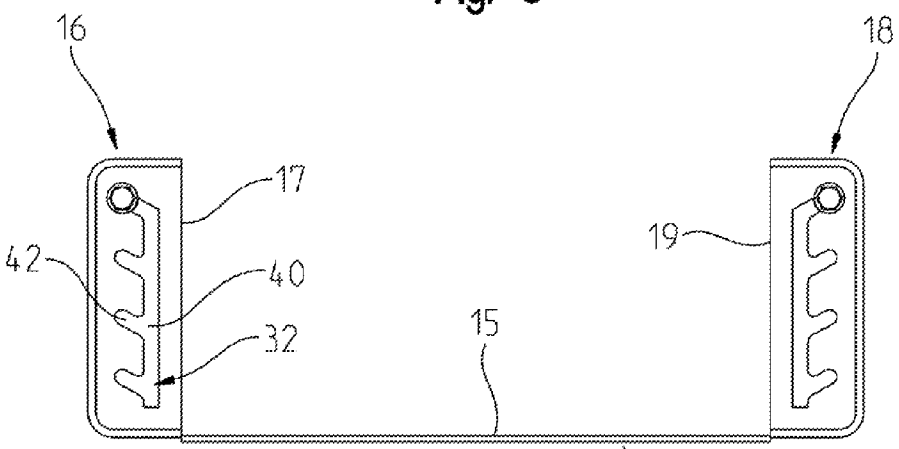
FIG. 5 is a front view thereof.
Figure 10:
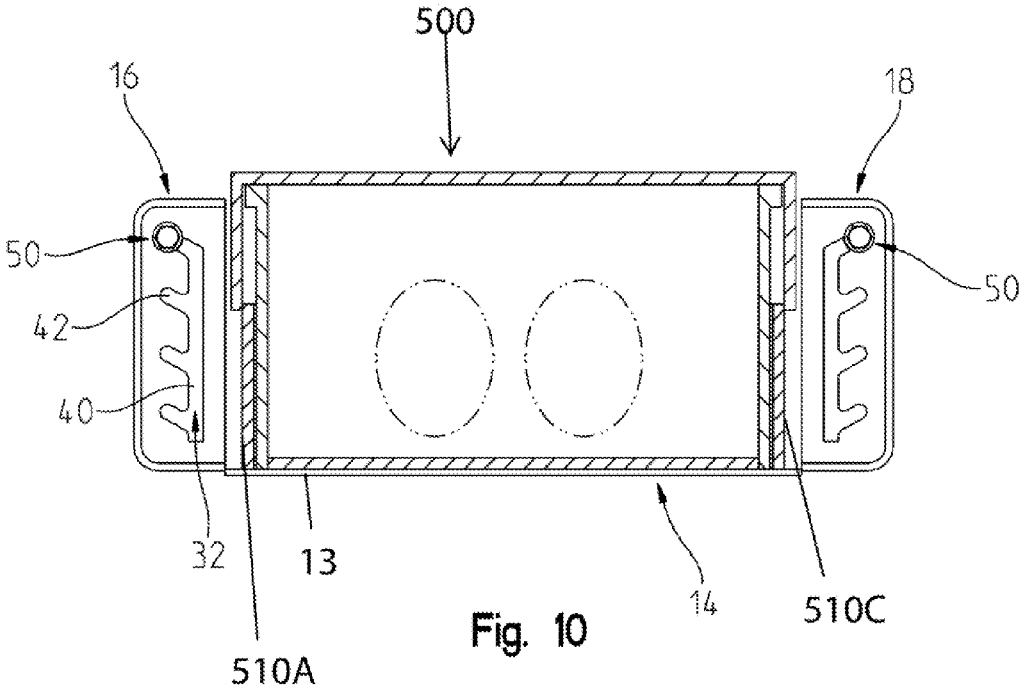
FIG. 10 is a sectional view taken along lines 10-10 of FIG. 8.

A bottom view of the casket carrier of the present invention is shown in FIG. 6, and a front side view is shown in FIG. 5. In FIG. 5, it is noteworthy that the upstanding members 16, 18 are disposed generally parallel to each other and are separated by a space wide enough to receive a cremation container there between. As best shown in FIG. 10, the cremation container is sized so that it can snuggly fit between the first and second upstanding members 16, 18, with the base member 14 being disposed under, and supporting the bottom surface of the container 500.

Figure 7:
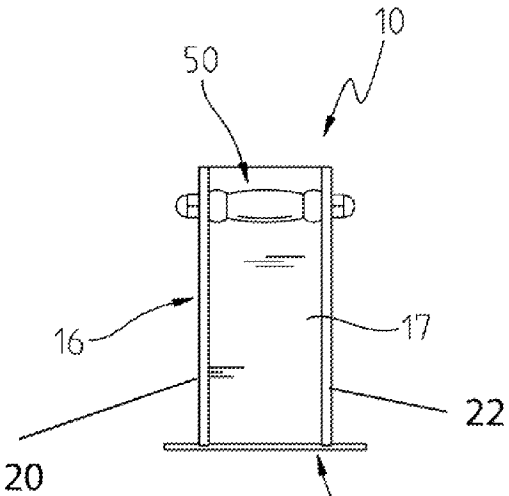
FIG. 7 is a side view thereof.
Figure 9:
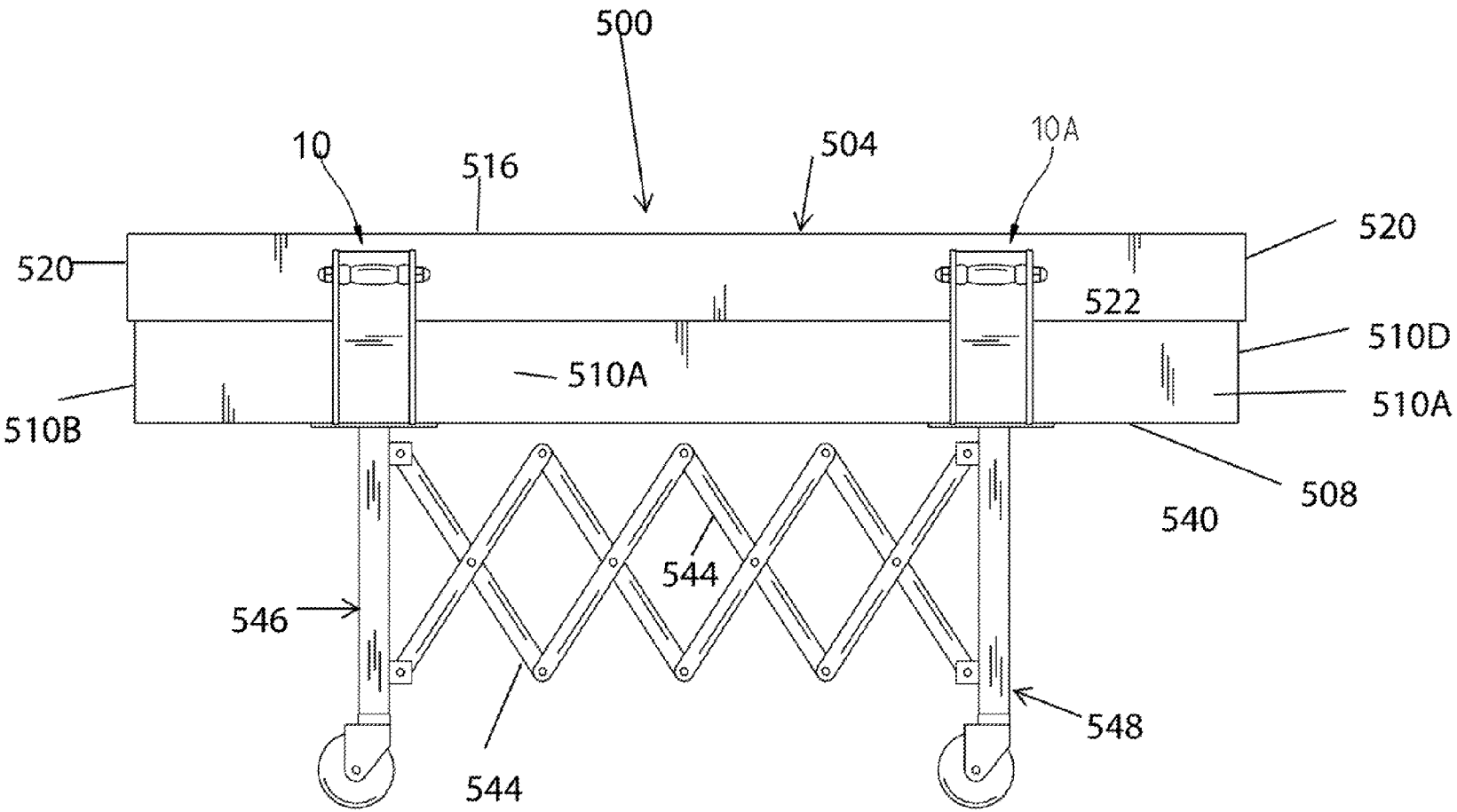
FIG. 9 is side view of a cremation casket placed on a church cart.

FIG. 7 shows a side view of the casket carrier and the handle 50 therefor. FIGS. 8, 9 and 10 show the casket carrier of the present invention in use. Turning first to FIG. 8, it will be noticed that a pair of casket carriers are engaged to an exemplary cremation casket 500.

Each of the carriers, 10, 10A are placed relative to the casket container 500 such that the base member 14 is disposed adjacent to and against the bottom surface of the cremation casket 500 to receive the underside surface of the cremation casket. One of the upstanding members 16 is disposed adjacent to a first long side surface 510A of the cremation container 500 and the second upright member 18 is disposed adjacent to the opposite long side surface 510C of the cremation casket 500. The base member 14 is sized so that it will extend all the way across the underside surface of the cremation container 500, so that the upstanding members 16, 18 are placed close to the side surfaces 510A, 510C of the cremation casket, but with enough room between the middle support portion (e.g. 17) of the upstanding member 16 and the side of the cremation casket 500 to provide for easy attachment of the casket carrier 10 to the casket and removal of the casket carrier 10 from the cremation casket 500.

Normally, because of the length of a cremation casket 500, it is preferred that two cremation carriers 10, 10A be used when moving or transporting a cremation casket 500. The two carriers 10, 10A are placed at a spaced distance apart. The distance between the two carriers is chosen with several criteria in mind. The first and most important criteria is to provide support for the cremation casket 500, and more particularly, the bottom of the cremation casket.

It will be appreciated that the tendency of the bottom of the cremation casket to sag or fold will be dependant to some extent on the distance between the lateral supports provided for the bottom surface of the casket 500 by the base members 14 of the casket 500. As such, placing the carriers 10, 10A adjacent to the respective first and second ends 510B, 510D of the cremation casket would leave a long unsupported area between the first and second carriers 10, 10A. This would probably be the position for the placement of the carriers 10, 10A wherein sagging or bending or folding would be most likely to occur.

However, by placing the carriers 10, 10A in a position so that the space between each of the carriers 10A, 10B and the end wall surface 510B, 510D, and also the distance between the two carriers 10A, 10B was approximately equidistant, one would minimize the unsupported length of any one particular segment of the cremation casket 500. Such a positioning would likely be a position wherein the cremation casket 500 was best supported so that it could resist sagging or bending under the influence of weight.

Because of the general strength of the cremation casket 500, such placement need not be made with precision. As such, there is probably a wide range of placement positions of the cremation casket carriers 10, 10A that will support the cremation carrier sufficiently so as to prevent this sagging and folding.

Turning now to FIG. 9, the first and second carrier members 10, 10A are spaced at a distance wherein they are slightly further apart as shown in FIG. 8. From the foregoing discussion, it would appear that this greater spacing is less advantageous to the relatively closer spacing of FIG. 8 because it leaves a larger, unsupported area between the first and second carriers 10, 10A. While that is true, a counter-veiling issue suggests that the placement is proper.

The counter-veiling issue relates to the church cart 540 upon which the casket is placed. As discussed above, and are shown in FIG. 2, most conventional church carts 540 are designed so that upstanding posts 546, 548 exist at the corners above the frame members that hold the wheels. These post members typically have a small diameter of about an inch or less. As such, the supporting posts 550 comprise supports for the casket, wherein the weight of the casket is borne over a relatively small area. This relatively small area causes the force to be placed on the cardboard or other material of the bottom surface of the cremation casket 500 to be quiet high, when measured in terms of pressure per unit of area. This large pressure placed on the underside surface over the small area can cause the posts 550 to puncture the underside surface of the casket 500.

To prevent this from happening, the base members 14 of the carriers 10, 10A are placed directly over the posts 550. The base member 14 of the carriers 10, 10A spreads the force of the casket 500 over the area of the base 14, which results in a significantly lower pressure per square area puncture force being imposed on the casket 500 than would be imposed if the casket 500 were resting solely on the four small posts. This additional area provided by the base member 14 drastically reduces the likelihood of the bottom of the casket 500 being punctured by the posts 550 of the church cart 540.

Additionally, when the cremation casket 500 is placed upon the church cart 540, the ability of the cremation casket 500 to sag or fold is also reduced significantly by the presence of the scissors springs 544 that are placed under the bottom surface 508 of the casket 500 and that connect the two end frames 546, 548 of the church cart 540 together. These spring members 544 can provide some additional underside surface support for the bottom surface 508 of the casket 500, and otherwise, limit the degree to which the bottom surface 508 of the cremation casket 500 can sag.

A second embodiment of the present invention is shown in FIGS. 11-17. The carrier 300 shown in FIGS. 11-17 is an alternate embodiment carrier 300, that is particularly well adapted for use in helping to transport permanent caskets such as permanent casket PC of FIGS. 11 and 17 and most particularly, helping to insert such permanent caskets PC into a mausoleum crypt or wall.

Figure 11:
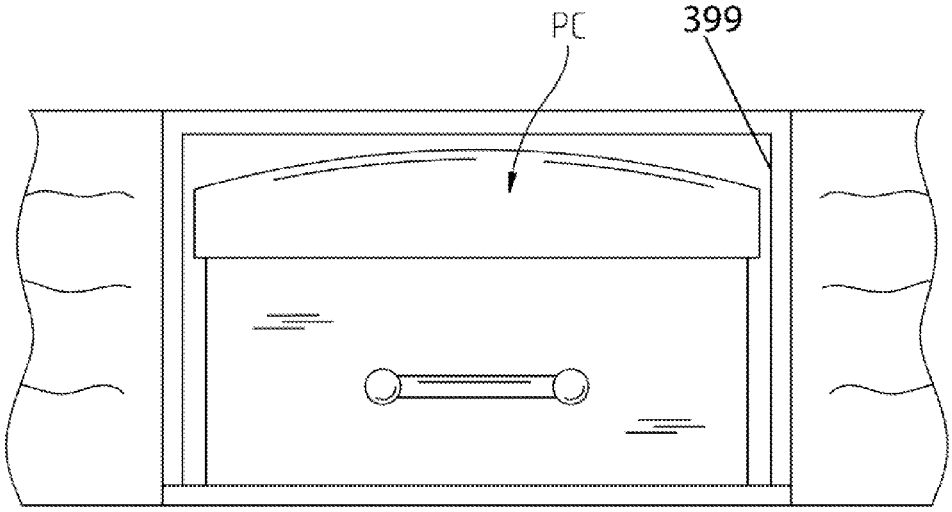
FIG. 11 is a front view of a permanent type casket placed in a mausoleum crypt, with the front plate of the crypt removed therefrom.

As discussed above, mausoleums are typically constructed so that they include a plurality of walls. Behind the walls are crypts 399 that are usually rectangularly cuboid and are sized and shaped for holding caskets PC. As caskets are typically of a uniform size, and as it is desirable to place as many crypts 399 (FIG. 11) as possible on a single wall for reasons of economics, the spaces provided for the crypts 399 are generally sized to receive the caskets PC in a semi-snug arrangement. In particular, the crypts 399 are designed so that there is provided about an inch or so of clearance on each side of a permanent casket PC, when a standard sized casket PC is placed in a crypt 399, such as is shown in FIG. 11.

Because of this narrow space, it is difficult to lift a casket to the height of the crypt, and to then insert the casket PC into the crypt 399. One factor that exacerbates this difficulty is that the casket PC handles can often not be employed for moving the casket, since the handles when engaged, tend to swing out from the body of the casket PC such that the handles when moved to their swung out or holding position cause the casket PC to have a width that is greater than the width of the crypt 399. Since many casket handles are either almost full length handles or at least half length handles, folding the handles in to their rest position renders them unuseable for gripping and carrying the casket. As such, the entire length of handles may be rendered unuseable at a point where the casket PC is inserted only a few inches into the crypt 399.

Interestingly, some of the most difficult crypts 399 into which to insert caskets are those crypts that are disposed along the bottom row of crypts closest to the floor. Caskets PC are especially difficult to insert into a crypt 399 on the bottom row of crypts because when positioned to be inserted into a crypt 399 on the bottom row, the casket PC is sufficiently close to the ground so that a cart or support cannot be placed under the casket PC, to provide a surface on which the casket PC an be placed to support the casket PC at the proper height, even with the height of the crypt 399, when the casket PC is being pushed into the crypt 399.

Interestingly, it is generally easier to insert a casket PC into a crypt 399 that is disposed in the upper row of crypts. Inserting a casket PC into an upper row crypt 399 is often easier because scissor type platform lifts are often employed by mausoleums to lift the casket to a level wherein the casket PC is supported at the same level as the crypt 399. Once the casket PC is at this level and positioned in front of the lift, the casket can be pushed into the crypt 399. To aid the movement of the casket PC into the crypt 399, it is not unusual for marbles to be placed on the floor of the crypt 399, and the casket rolled over the marbles, that serve as rollers for the casket PC.

Figure 17:
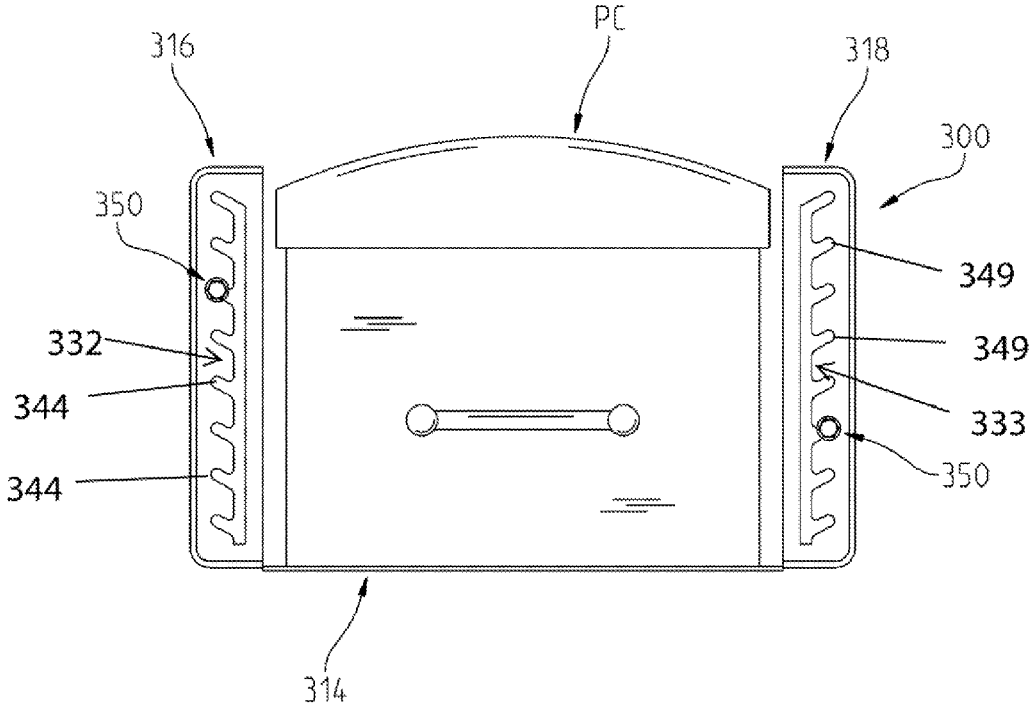
FIG. 17 is a front side view of the carrier being used to engage a casket, wherein the carrier is being used to help insert the casket within a niche of a mausoleum type crypt.

As best shown in FIGS. 12-17, the second embodiment casket carrier 300 is constructed to be generally similar to the first embodiment casket carrier 10. Casket carrier 300 includes a stainless steel base member 314 that is generally planar in nature. The width of the planar member 314 is typically about 28.5 inches. This width is just wide enough to accept a typical 27 inch wide permanent casket PC, such as is shown in FIG. 17.

A first upstanding member 316 is disposed on a first side edge of the base member 314 and a second upstanding member 318 is disposed at a second edge of the base member 314. The upstanding members 316, 318 each include a generally planar solid central portion 317, 319. First 320, 324 and second 322, 326 side members are disposed along a fold line formed at the intersection of the inner portion of the side sections and the side edges of the central portion 317, 319.

Figure 14:
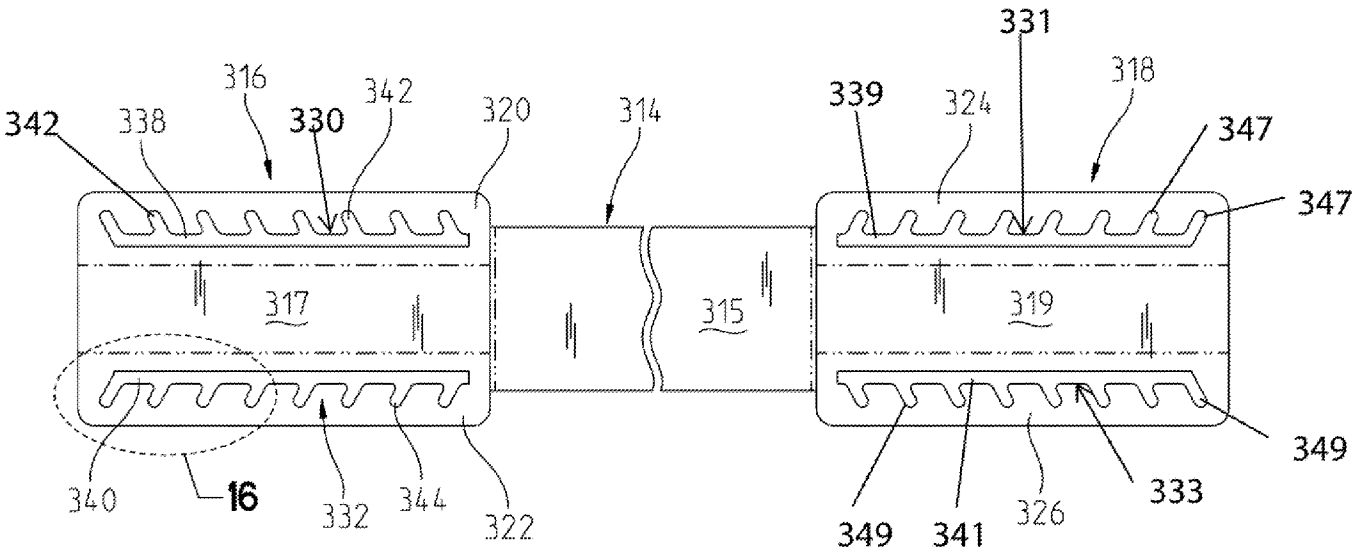
FIG. 14 is a bottom view of the carrier of a "flattened" present invention, showing the sheet of steel from which the carrier can be made, prior to bending portions of the sheet to form appropriately positioned and sized flanges.
Figure 16:
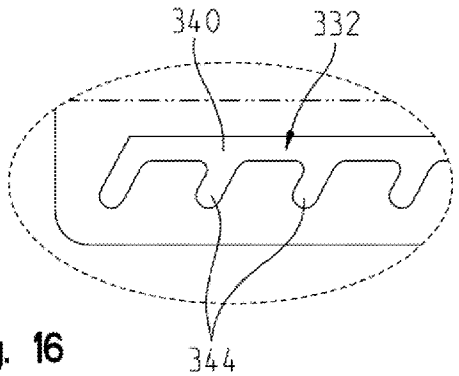
FIG. 16 is a carrier of the present invention.
Figure 15:
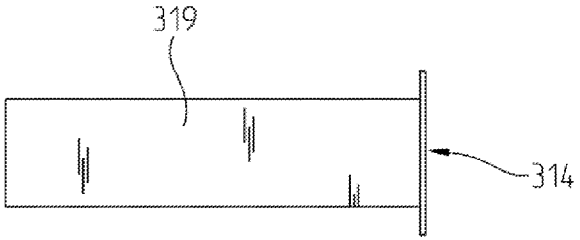
FIG. 15 is a detailed view taken in circle detail A of FIG. 14.

Turning now to FIG. 14 the carrier 300 is shown in its pre-assembled condition. Essentially, one starts with a flat piece of metal, cuts out the exterior surfaces, and then cuts out the slots about their joinder line with the base 314 so that the first and second upstanding members 316, 318 extend in parallel planes with each other, and in a plane perpendicular to the base member 314.

Figure 12:
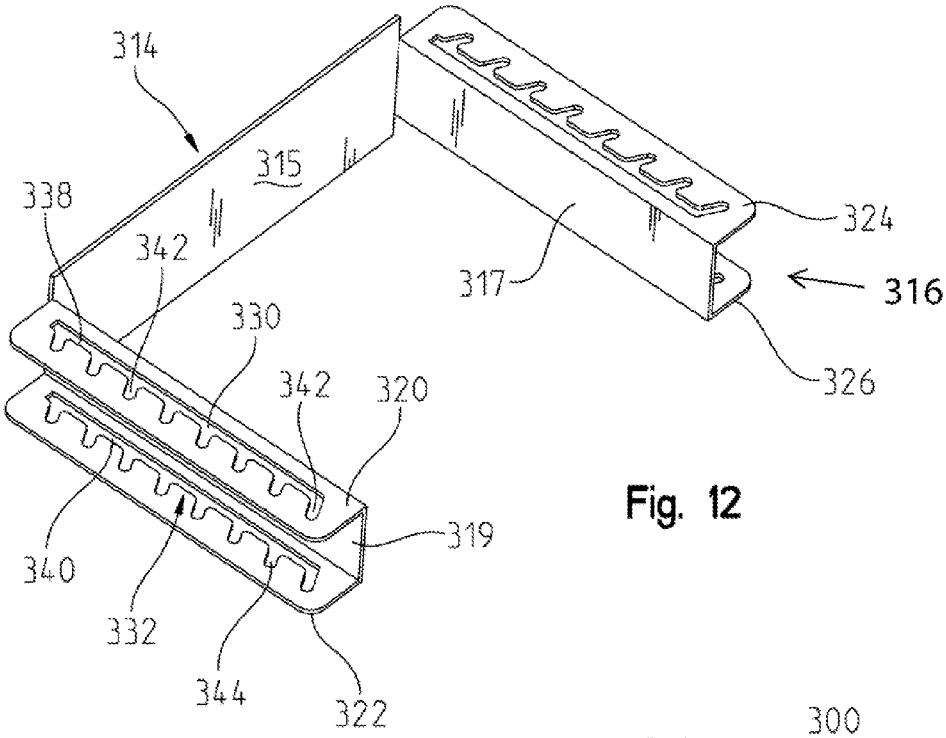
FIG. 12 is a perspective view of a first alternate embodiment container carrier of the present invention that is especially adapted for use in carrying containers, such as both temporary and permanent caskets, and for helping to insert such caskets into a mausoleum crypt (niche)
Figure 13:
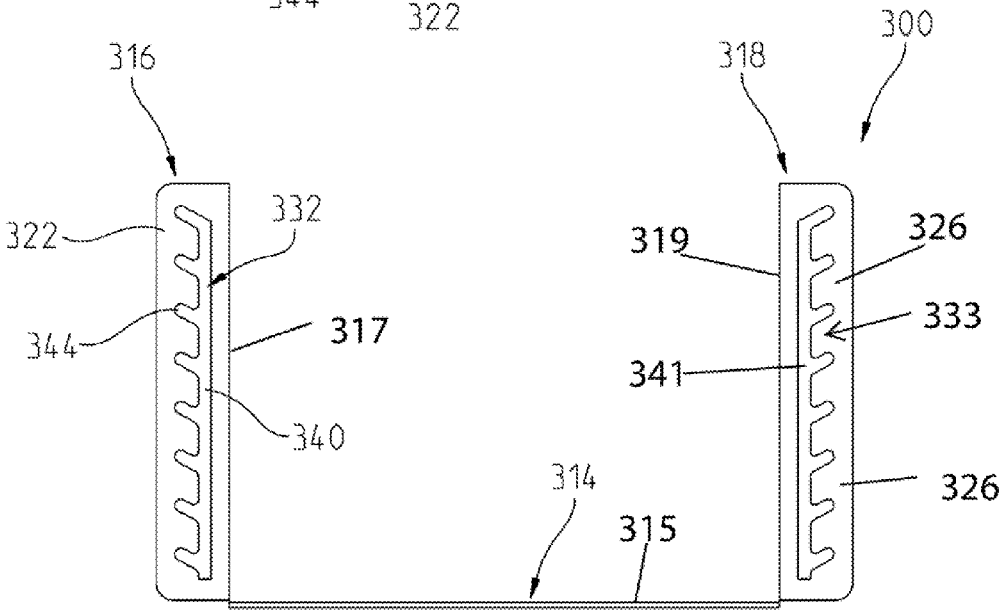
FIG. 13 is a front side view of the first alternate embodiment carrier of the present invention.

The first 320, 324 and second 322, 326 flange-like side members are disposed in planes that are parallel to each other and generally perpendicular to the base portion 314 and the central portions 317, 319. Both of the first 320, 324 and second 324, 326 side section members are bent so that they extend outwardly from the central support portion 317, 319, respectively as shown in FIG. 12 so that the respective slots, such as first slots 332 are aligned so that a handle, such as handle 50 shown in FIG. 4 can extend between the respective slots, 330, 332.

The slots 330, 332 are generally similarly constructed to slots 30, 32 as they include a longitudinally connecting portion 338, 339, 340, 341 and a plurality of branch like resident handle receiving adjustment slot portions 342, 344 in which the handle can reside, when the device is being used.

Probably the greatest difference between the carrier of the first 10 and second 300 embodiments is the carrier 300 of the second embodiment includes slots 330-333 having longer longitudinal connector portions 338-341 which thereby permits a greater number of adjustment slots 342-349, which thereby increases the range and variability of the adjustment of the handles of the carrier. In a most preferred embodiment for example, the length of the upstanding member 316, 318 of the second embodiment is approximately twenty-one inches whereas the upstanding portions 16, 18 of the first embodiment may only be eleven inches.

This additional height (length) of the upstanding members is especially useful when the carrier 300 is being used to transport a permanent casket PC and the permanent casket PC is being inserted into a crypt 399. The additional length enables the user to grab the handle while bending over less, to enable the user to handle the casket more ergonomically correctly and more comfortably than if a shorter upstanding portion were used, as such a shorter upstanding portion would force the user to bend over further.

Further, since the handle 350 can grip any one of a plurality of resident adjustment slots 342, 344, 347, 349 the user can very easily change the gripping position at which the handle grips the upstanding portion 316, 318 so that the handle 350 can be adjusted so that the handle 350 is placed at a height that helps to maximize the comfort and ergonomic correctness of the carrier for the user.

In this regard, it is likely that one of the factors that will cause someone to adjust the handle 350, is the particular height of the row of crypts into which the permanent casket is being inserted, and a second factor is the particular height of the pall bearers, as users of different heights often have a difference in the distance between their hands and the ground when standing. As such, the use of different handle positions by different users may help to maintain the casket in a level orientation.

Turning now to FIG. 17, handles 350 are shown being engaged to resident adjustment slots 344, 349 at different heights, to help illustrate a situation wherein different users might wish to adjust the handle differently because of their differences in height.

Having described the invention in detail with respect to certain preferred embodiments, it will be appreciated that variations and modifications exist within the scope and spirit of the present invention, and the range of equivalence to which the present invention is entitled should be limited only by the law and the prior art.

What is claimed:

1. A carrier for facilitating the carrying and transportation of a funerary container having a bottom surface, a plurality of side surfaces and a top surface, and a length and width and interior large enough to accommodate an un-cremated corpse, the carrier comprising a strap shaped base member having a length generally long enough to span the width of the funerary container, a width less than half of the length, and an upper surface sized and configured for receiving a portion of the bottom surface of the funerary container, an upstanding member having a lower end coupled to the base member and an upper end, the upstanding member extending in a plane generally perpendicular to the base member, wherein the upstanding member includes a central section, a first side section coupled to the central section at a first fold line and a second side section coupled to the central section at a second fold line, the first and the second side sections being disposed in planes that are parallel to each other and perpendicular to a plane in which the central section is disposed and a handle coupled to the upstanding member, the handle including a hand receiving surface engageable by the hand of a user.

2. The carrier of claim 1 wherein the base member has a length of at least about 28 inches and a width of at least about four inches.

3. The carrier of claim 1 wherein the first and second side sections include handle engaging portions, and the handle engages the handle engaging portion of the first and second side sections.

4. The carrier of claim 1 wherein the upstanding member includes a plurality of handle engaging portions for permitting the user to vary the position at which the handle engages the upstanding member.

5. A carrier for facilitating the carrying and transportation of a funerary container having a bottom surface, a plurality of side surfaces and a top surface, and a length and width and interior large enough to accommodate an un-cremated corpse, the carrier comprising a base member having a length generally long enough to span the width of the funerary container and an upper surface sized and configured for receiving the bottom surface of the funerary container, an upstanding member having a lower end coupled to the base member and an upper end, the upstanding member extending in a plane generally perpendicular to the base member, the upstanding member including a central section and at least a first side section, and a second side section disposed in a plane generally parallel to a plane in which the first side section is disposed, each of the first and second side sections being disposed in planes generally perpendicular to a plane in which the central section is disposed, and a handle coupled to the upstanding member, the handle including a hand receiving surface engageable by the hand of a user, wherein the first and second side sections include handle engaging portions, and the handle engages the handle engaging portion of the first and second side sections, each of the first and second side sections including a plurality of the handle engaging portions for permitting the user to vary the position at which the handle engages the side sections.

6. The carrier of claim 5 wherein the handle includes a first rod portion for engaging the first side section, and a second rod portion for engaging the second side section.

7. The carrier of claim 5 wherein the handle engaging portions of each of the first and second side sections includes a longitudinal slot in communication with a plurality of spaced adjustment slots.

8. The carrier of claim 7 wherein the longitudinal slots of the handle engaging portion of the first and second side sections extend between the plurality of adjustment slots, and wherein the adjustment slots are disposed at an oblique angle to the longitudinal slots.

9. A carrier for facilitating the carrying and transportation of a funerary container having a bottom surface, a plurality of side surfaces and a top surface, and a length and width and interior large enough to accommodate an un-cremated corpse, the carrier comprising a base member having a length generally long enough to span the width of the funerary container and an upper surface sized and configured for receiving the bottom surface of the funerary container, an upstanding member having a lower end coupled to the base member and an upper end, the upstanding member extending in a plane generally perpendicular to the base member, the upstanding member comprising a unitary upstanding member including a central section disposed in a plane generally perpendicular to a plane in which the base member is disposed, a first side section attached to the central section along a fold line and disposed in a plane generally perpendicular to the plane of central section, and a second side section attached to the central section along a fold line and disposed in a plane generally parallel to the plane in which the first side section is disposed and a handle coupled to the upstanding member, the handle including a hand receiving surface engageable by the hand of a user.

10. The carrier of claim 9 wherein the first and second side sections include a handle engaging portion, the handle engaging portion including a first longitudinal slot formed in the first side section and a second longitudinal slot formed in the second side section in an aligned relation with the first longitudinal slot, a plurality of spaced, first adjustment slots extending at oblique angles from the first longitudinal slot and a plurality of spaced second adjustment slot extending at oblique angles from the second longitudinal slot.

11. The carrier of claim 10 wherein the first adjustment slot and second adjustment slot are aligned, and wherein the handle includes a first rod shaped end portion sized and configured for being received in the first longitudinal slot and first adjustment slots, and a second rod shaped end portion sized and configured for being received concurrently in a corresponding arm of the second longitudinal slot and second adjustment slots.

12. A carrier for facilitating the carrying and transportation of a funerary container having a bottom surface, a plurality of side surfaces and a top surface, and a length and width and interior large enough to accommodate an un-cremated corpse, the carrier comprising a base member having a length generally long enough to span the width of the funerary container and an upper surface sized and configured for receiving a portion of the bottom surface of the funerary container, the base member including a first end and a second end, an upstanding member having a lower end coupled to the base member and an upper end, the upstanding member extending in a plane generally perpendicular to the base member, the upstanding member comprising a first upstanding member and is coupled to the first end of the base member, and a second upstanding member coupled to the second end of the base member, the second upstanding member including a central section disposed in a plane generally perpendicular to the plane in which the base member is disposed, and in a plane generally parallel to the plane in which the central section of the first upstanding member is disposed, the second upstanding member including a first side section coupled to the central section at a first fold line and a second side section coupled to the central section at a second fold line, the first and the second side sections being disposed in planes that are parallel to each other and perpendicular to a plane in which the central section is disposed, and a handle coupled to the upstanding member, the handle including a hand receiving surface engageable by the hand of a user.

13. A carrier for facilitating the carrying and transportation of a funerary container having a bottom surface, a plurality of side surfaces and a top surface, and a length and width and interior large enough to accommodate an un-cremated corpse, the carrier comprising a strap shaped base member having a length generally long enough to span the width of the funerary container, a width less than half or the length, and an upper surface sized and configured for receiving a portion of the bottom surface of the funerary container, an upstanding member having a lower end coupled to the base member and an upper end, the upstanding member extending in a plane generally perpendicular to the base member, and a handle coupled to the upstanding member, the handle including a hand receiving surface engageable by the hand of a user, wherein the base member includes a first end and a second end, and wherein the upstanding member comprises a first upstanding member and is coupled to the first end of the base member, further comprising wherein the upstanding member comprises a second upstanding member coupled to the second end of the base member, the second upstanding member including a central section disposed in a plane generally perpendicular to the plane in which the base member is disposed, and in a plane generally parallel to the plane in which the central section of the first upstanding member is disposed, and wherein the first and second upstanding member include a handle engaging portion, the handle engaging portion including a first longitudinal slot formed in the first upstanding member and a second longitudinal slot formed in the second upstanding member in an aligned relation with the first longitudinal slot, a plurality of spaced first adjustment slots extending at oblique angles from the first longitudinal slot, and a plurality of spaced second adjustment slots extending at an oblique angle from the second longitudinal slot.

14. A carrier for facilitating the carrying and transportation of a funerary container having a bottom surface, a plurality of side surfaces and a top surface, and a length and width and interior large enough to accommodate an un-cremated corpse, the carrier comprising a base member having a length generally long enough to span the width of the funerary container and an upper surface sized and configured for receiving the bottom surface of the funerary container, an upstanding member having a lower end coupled to the base member and an upper end, the upstanding member extending in a plane generally perpendicular to the base member, and a handle coupled to the upstanding member, the handle including a hand receiving surface engageable by the hand of a user the handle including a rod shaped member and the upstanding member including at least a first and a second spaced positional slot, the rod shaped member being selectively engageable in each of the first and second slots to permit the user to vary the position of the handle, depending upon whether the handle engages the first or the second slot.

15. The carrier of claim 14 wherein the upstanding member includes a first and second side section each having the first and second spaced positional slot, wherein the handle includes first and second end portions that extends outwardly through the respective first or second slot of the first and second side section, further comprising a retainer for retaining the first and second end portions in the respective first or second slot.

* * * * *